US011882921B2

(12) United States Patent
Cope et al.

(10) Patent No.: US 11,882,921 B2
(45) Date of Patent: Jan. 30, 2024

(54) EXPANDABLE SLING BAG

(71) Applicant: WANDRD, LLC, Orem, UT (US)

(72) Inventors: Spencer N. Cope, Provo, UT (US); Zackary B. Cluff, Heber City, UT (US)

(73) Assignee: WANDRD, LLC, Orem, UT (US)

( * ) Notice: Subject to any disclaimer, the term of this patent is extended or adjusted under 35 U.S.C. 154(b) by 91 days.

(21) Appl. No.: 17/330,404

(22) Filed: May 25, 2021

(65) Prior Publication Data

US 2022/0378178 A1 Dec. 1, 2022

(51) Int. Cl.
*A45F 3/02* (2006.01)
*A45F 3/00* (2006.01)

(52) U.S. Cl.
CPC ..... *A45F 3/02* (2013.01); *A45F 2003/003* (2013.01); *A45F 2200/0525* (2013.01)

(58) Field of Classification Search
CPC ..... A45F 3/02; A45F 2200/0525; A45C 7/0063; A45C 2011/003
USPC ..... 224/581; 190/103
See application file for complete search history.

(56) References Cited

U.S. PATENT DOCUMENTS 3,122,225 A * 2/1964 Ward ..... A45C 7/0063 D3/902
4,236,615 A * 12/1980 Ginat ..... A45C 7/0068 383/41
4,334,601 A * 6/1982 Davis ..... A45C 3/00 190/111
4,361,215 A * 11/1982 Sawai ..... A45C 7/0027 190/103
D284,623 S * 7/1986 Gerch ..... D3/274
4,613,039 A * 9/1986 Shaw ..... A47G 25/54 190/103
D292,748 S * 11/1987 Allen ..... D3/274
5,217,119 A * 6/1993 Hollingsworth ..... A45C 13/02 190/902
D346,694 S * 5/1994 Cyr ..... D3/287
5,743,447 A * 4/1998 McDermott ..... A45C 7/0086 224/583
5,887,770 A * 3/1999 Covell ..... A45F 3/02 224/614
5,964,384 A * 10/1999 Young ..... A45C 7/0063 190/111
D417,782 S * 12/1999 Tawil ..... D3/289
6,015,072 A * 1/2000 Young ..... A45C 7/0063 383/111

(Continued)

*Primary Examiner* — Justin M Larson
(74) *Attorney, Agent, or Firm* — Dentons Durham Jones Pinegar

(57) ABSTRACT

An expandable sling bag has a shape and a shoulder strap that enable the sling bag to be worn across an individual's back, chest and/or abdomen, or side, under the individual's arm. The expandable sling bag includes an expandable receptacle that enables the sling bag to accommodate an oversized item, such as a portable computer, a sleeve for a portable computer, or the like, with dimension that exceed a height of the sling bag. More specifically, the expandable sling bag may include a receptacle with an opening at its top, an expandable base positionable within a bottom portion of the receptacle, and a bottom opening through which the expandable base may be extended to expand a length of the receptacle. Methods of using an expandable sling bag to carry oversized items are also disclosed.

18 Claims, 6 Drawing Sheets

(56) References Cited

U.S. PATENT DOCUMENTS

| | | | | |
|---|---|---|---|---|
| 6,053,382 | A * | 4/2000 | Wyant | A45C 7/0068 190/103 |
| 6,237,764 | B1 * | 5/2001 | Kastelic | A45C 3/00 190/15.1 |
| 6,237,766 | B1 * | 5/2001 | Hollingsworth | A45C 13/02 190/110 |
| 6,305,587 | B1 * | 10/2001 | Miller | G06F 1/1628 224/582 |
| 6,536,638 | B1 * | 3/2003 | Gulmatico, III | A45F 3/04 224/586 |
| 7,036,642 | B2 * | 5/2006 | Hoberman | A45C 13/02 190/902 |
| 8,474,613 | B2 * | 7/2013 | Murdoch | A45C 11/00 224/675 |
| 9,049,916 | B2 * | 6/2015 | Berei | A45F 3/04 |
| D734,032 | S * | 7/2015 | Robinson | D3/289 |
| 9,210,976 | B2 * | 12/2015 | Maeda | A45C 7/0054 |
| 9,289,049 | B2 * | 3/2016 | Kienel | A45F 3/04 |
| 9,320,341 | B2 * | 4/2016 | Majeau | A45F 3/04 |
| D858,987 | S * | 9/2019 | Zhang | D3/289 |
| 2004/0195286 | A1 * | 10/2004 | Greenhalgh | A45F 3/04 224/653 |
| 2005/0286807 | A1 * | 12/2005 | Matheus | A45C 7/0063 190/103 |
| 2015/0041271 | A1 * | 2/2015 | Reese | A45C 7/0045 190/103 |
| 2022/0378178 | A1 * | 12/2022 | Cope | A45C 7/0063 |

* cited by examiner

EXPANDABLE SLING BAG

TECHNICAL FIELD

This disclosure relates generally to a sling bag with a shape and a shoulder strap that enable the sling bag to be worn across an individual's back or chest. More specifically, this disclosure relates to a sling bag that can carry a portable computer, such as a laptop or a large tablet computer. Even more specifically, this disclosure relates to a sling bag with a receptacle that expands. Methods of carrying portable computers and other items with sling bags are also disclosed.

RELATED ART

Bags come in a variety of shapes and sizes. Many bags are configured to be worn on a particular location on an individual's body. For example, shoulder bags may be worn over an individual's shoulder and carried against the individual's side. Backpacks, including smaller backpacks that are often referred to as "day packs," are made to be carried over an individual's back.

So-called "sling" bags are typically smaller bags with straps that enable them to be carried over a plurality of different locations on an individual's body, including his or her back, chest and/or abdomen, and/or side. In addition to the versatility in how sling bags can be carried, the relatively small sizes of sling bags make them desirable for everyday use in carrying a variety of items, including photographic equipment. Since sling bags are typically short, however, there are some limitations on the sizes of items they can carry. Because of their short heights, sling bags typically cannot be used to carry portable computers, such as laptop computers and larger tablet computers.

SUMMARY

In various aspects and embodiments, sling bags with an expandable receptacles are disclosed. Such a sling bag may include a bag body and an expandable base. The bag body has a width and a height, with the width of the bag body exceeding the height of the bag body. The bag body may define, or include, a primary receptacle accessible through a primary opening in a top of the bag body, as well as a secondary receptacle accessible from a secondary opening in the top of the bag body. The secondary receptacle may be located behind the primary receptacle, or at a rear of the bag body of the sling bag.

A bottom portion of the secondary receptacle may carry an expandable base. The expandable base, which may extend across the secondary receptacle (i.e., between its front and its rear), may be collapsed within the secondary receptacle. A bottom opening in the bag body, when open, may provide access to the bottom portion of the secondary receptacle and the expandable base therein. In some embodiments, the expandable base may comprise a pocket. When such an expandable base is in an inverted orientation within the secondary receptacle, it may define a tertiary receptacle that is isolated from the secondary receptacle and accessible through the bottom opening. The bottom opening in the bag body, when open, may also enable extension of the expandable base out of a bottom of the bag body.

Lengths of the secondary opening and the bottom opening and a width of the secondary receptacle may enable the secondary opening, the secondary receptacle, and the bottom opening to receive an oversized item, such as a sleeve for a portable computer (e.g., a laptop computer, a large tablet computer, etc.) or the portable computer itself. When an item such as a sleeve, a portable computer, or the like is inserted into the extended secondary receptacle, a first edge of the item may protrude above a top of the sling bag, a central portion of the item may be located within a main portion of the secondary receptacle, between the secondary opening and the bottom opening, and a second edge of the item may be located in the expanded portion of the secondary receptacle and, thus, protrude beyond a bottom of the sling bag. The expandable base holds the bottommost, second edge of the item in place. In addition, a retention system may be positioned over the topmost, first edge of the item to secure the item in place within the secondary receptacle and, thus, relative to a remainder of the sling bag.

The sling bag may also include a shoulder strap. The shoulder strap may be secured to the bag body in a manner that enables the sling bag to be worn over an individual's chest, abdomen, side, or back.

In another aspect, a method is disclosed for carrying a sleeve for a portable computer, a portable computer, or other items that could not ordinarily be carried by a sling bag. Such a method may include opening a bottom opening in a bottom of the sling bag, extending an expandable base through the bottom opening, and introducing the sleeve, the portable computer, or the other item into a secondary opening in a top of the sling bag, at least partially through the secondary receptacle, and through the bottom opening and into the expandable base. A first edge of the sleeve, the portable computer, or the other item may extend beyond the top of the sling bag. The expandable base and a second edge of the sleeve, the portable computer, or the other item therein may extend beyond the bottom of the sling bag. The first edge of the sleeve, the portable computer, or the other item may also be secured in place. For example, a retention system may be placed over the first edge and secured to a bag body of the sling bag.

Upon removing the sleeve, the portable computer, or the other item from expanded secondary receptacle, the expandable base may be pushed through the bottom opening and into a bottom portion of the secondary receptacle. As the expandable base is pushed into the bottom portion of the secondary receptacle, the expandable base may collapse within the bottom portion of the secondary receptacle. A closure associated with the bottom receptacle may be placed in a closed arrangement. The retention system, if any, may be pushed through the secondary opening and into a top portion of the secondary receptacle. A closure associated with the secondary opening may be placed in a closed arrangement.

The secondary opening and the bottom opening may respectively provide access to top and bottom portions of the secondary receptacle, which may store small items when in its unexpanded state. In some embodiments, the expandable base, while in an inverted orientation within the secondary receptacle, may define a tertiary receptacle that is isolated from the secondary receptacle.

Other aspects of the disclosed subject matter, as well as features and advantages of various aspects of the disclosed subject matter, will be apparent to those of ordinary skill in the art through consideration of ensuing description, the accompanying drawings, and the appended claims.

DETAILED DESCRIPTION

Figure 1:
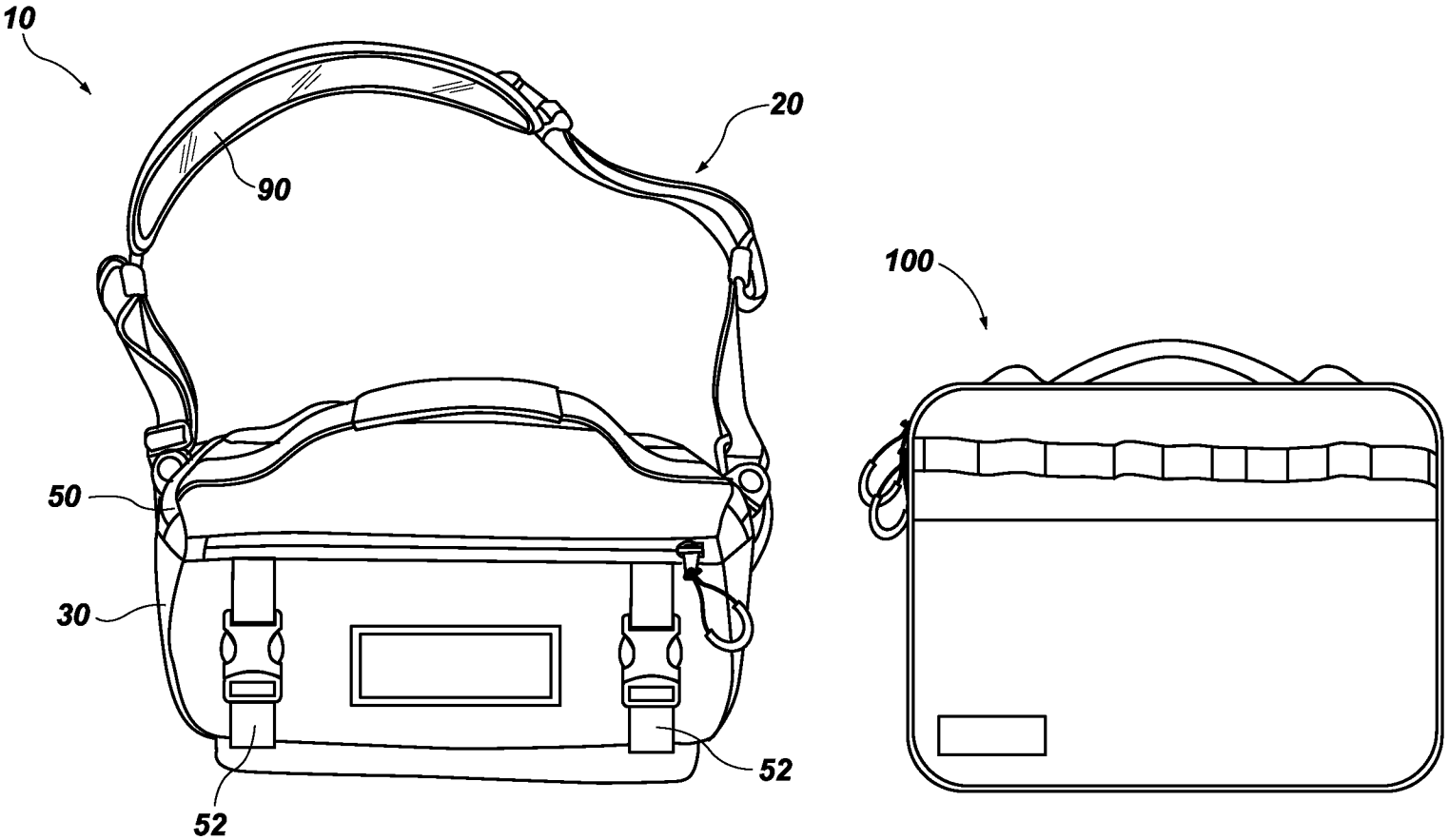
FIG. 1 depicts an embodiment of a sling laptop carrying system that includes a sling bag and a sleeve for a portable computer, with the sling bag in a compact arrangement.

FIG. 1 depicts an embodiment of a sling laptop carrying system 10 of this disclosure. The sling laptop carrying system 10 includes a sling bag 20 and an optional sleeve 100 for a portable computer. The sling bag 20 includes a bag body 30 and a shoulder strap 90 connected to the bag body 30. In addition to the bag body 30 and the shoulder strap 90, the sling bag 20 may include a cover 50 that may be positioned over a primary receptacle 40 (not shown in FIG. 1) of the bag body 30.

The bag body 30 of the sling bag 20 may have a width that exceeds its height. Thus, the bag body 30 is relatively wide and short, enabling the sling bag 20 to be worn across an individual's body at a variety of locations, such as his or her back or his or her chest and/or abdomen. In some arrangements, a shape and dimensions of the bag body 30 of a sling bag 20 may enable the sling bag 20 to be worn on an individual's side, under his or her harm. In contrast, backpacks, due to their heights, which typically exceed their widths, typically cannot be worn anywhere other than on an individual's back.

With added reference to FIGS. 2-5, the bag body 30 of the sling bag 20 may include a top 32, a bottom 33, a front 34, a rear 35, and sides 36 and 37. The bottom 33 extends between bottom edges of the front 34 and rear 35 of the bag body 30. Each side 36, 37 extends between corresponding side edges of the front 34 and rear 35 of the bag body 30. The sides 36 and 37 may be continuous with, or comprise extensions of, the bottom 33 of the bag body 30.

The various elements and features of the bag body 30, including but not limited to its top 32, bottom 33, front 34, rear 35, and sides 36 and 37, may be made from any of a variety of suitable materials, including, without limitation, fabrics (e.g., nylon, canvas, denim, etc.), leather, artificial leather, plastic (e.g., vinyl, etc.), and the like. The elements and features of the bag body 30 may be assembled and secured to each other in any suitable manner known in the art. By way of example, the bag body 30 may be sewn, joined by mechanical fasteners (e.g., rivets, buttons, wires, etc.), thermally bonded, adhesively bonded, or in any suitable manner of any combination of suitable manners.

In some embodiments, a pad 38 may be associated with the rear 35 of the bag body 30. The rear 35 may comprise the pad 38 or the pad 38 may be secured (e.g., sewn, thermally bonded, adhesively bonded, etc.) to an outside surface of the rear 35. The pad 38 may comprise a cushion (e.g., a neoprene cushion, another foam rubber cushion, a silicone cushion, etc., which may be enclosed in a fabric shell), which may increase the comfort with which the sling bag 20 may be worn against an individual's body and/or protect the contents of the sling bag 20.

The cover 50 may have any suitable configuration. As illustrated, the cover 50 may pivot relative to the bag body 30 in a manner that enables the cover 50 to selectively cover an opening 42 to the primary receptacle 40 of the bag body 30 or expose the opening 42 and the primary receptacle 40. One or more straps 52 (FIG. 1) may be associated with the cover 50 and the front 34 of the bag body 30 in a manner that enables the straps 52 to secure the cover 50 in place over the opening 42 to the primary receptacle 40 of the bag body 30.

The sling bag 20 may also include a handle 54 on the cover 50. The handle 54 may enable an individual to carry the sling bag 20 with his or her hand when the individual is not using the shoulder strap 90 to carry (e.g., by wearing, etc.) the sling bag 20.

Figure 2:
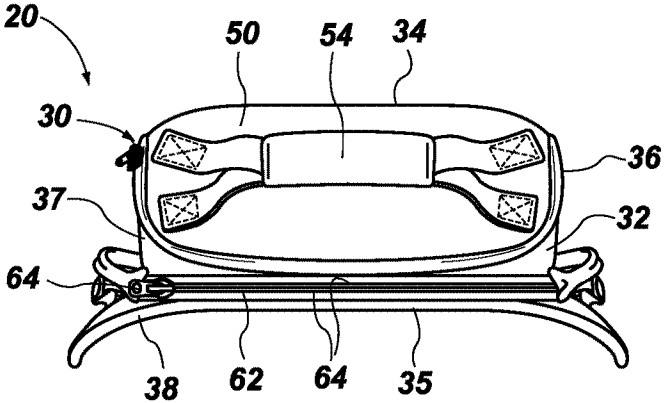
FIG. 2 is a top view of the embodiment of sling bag shown in FIG. 1, showing a cover in a closed position over a primary receptacle of the bag body of the sling bag and a secondary opening that provides access to a secondary receptacle of the bag body in a closed arrangement.
Figure 3:
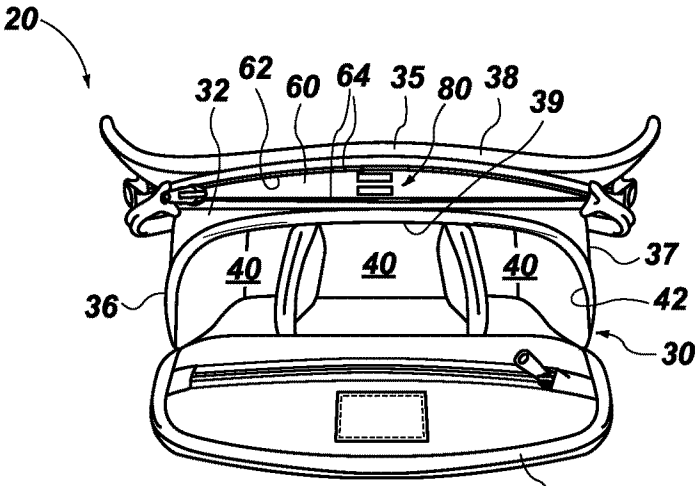
FIG. 3 is another top view of the embodiment of sling bag shown in FIG. 1, with the cover in an open position, revealing the primary receptacle, and the secondary opening open, revealing the secondary receptacle of the bag body of the sling bag.

FIGS. 2 and 3 provide top views of the sling bag 20 and, thus, show the top 32 of the bag body 30. FIG. 3 shows the cover 50 in an open position that exposes an opening 42 to the primary receptacle 40 of the bag body 30 and, thus, enables an individual to access the primary receptacle 40 through the opening 42 of the bag body 30. FIG. 2 shows the cover 50 in a closed position over the over the primary receptacle 40.

The top 32 of the bag body 30 also includes a secondary opening 62. A closure 64 (e.g., a zipper, etc.) may be associated with the secondary opening 62 in a manner that enables the secondary opening 62 to be selectively opened, as shown in FIG. 3, and closed, as shown in FIG. 2. As shown in FIG. 3, the secondary opening 62 provides access to a secondary receptacle 60 of the bag body 30. The secondary opening 62 and the secondary receptacle 60 may be located behind the primary receptacle 40 of the bag body 30 and separated from the primary receptacle 40 by way of an internal partition 39.

In some embodiments, the internal partition 39 of the bag body 30 may comprise a cushion (e.g., a neoprene cushion, another foam rubber cushion, a silicone cushion, etc., which may be enclosed in a fabric shell). Alternatively, the internal partition 39 may comprise a somewhat rigid material (e.g., a thick sheet of plastic, etc.). As an internal partition 39 is located on the front side of the secondary receptacle 60 of the bag body 30, an internal partition 39 that includes a cushioning material and/or or a somewhat rigid material may protect the contents of the secondary receptacle 60 from impacts by the contents of the primary receptacle 40 of the bag body 30. In embodiments were the sling bag 20 includes a pad 38, the pad 38 may protect a rear side of the secondary receptacle 60 of the bag body 30 from impacts by objects outside of the sling bag 20.

Figure 4:
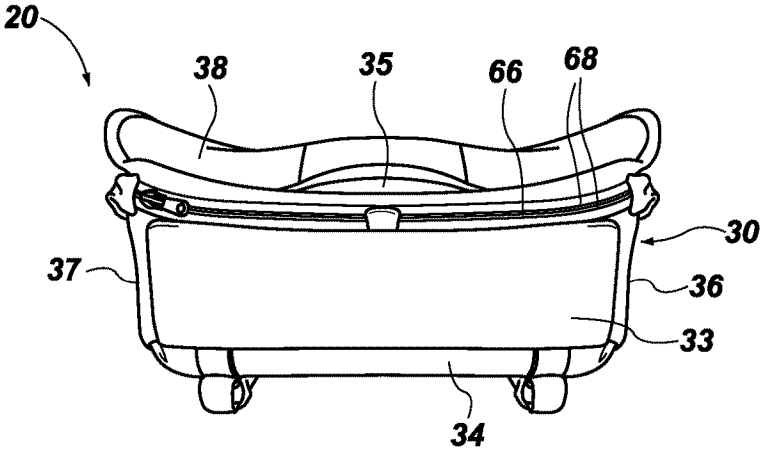
FIG. 4 is a bottom view of the embodiment of sling bag shown in FIG. 1, showing a bottom opening in a closed arrangement.
Figure 5:
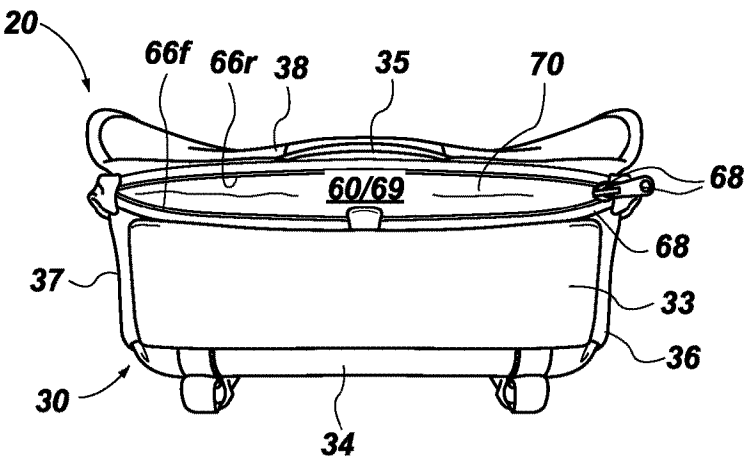
FIG. 5 is another bottom view of the embodiment of sling bag shown in FIG. 1, showing the bottom opening in an open arrangement.

FIGS. 4 and 5 provide bottom view of the sling bag 20 and, thus, show the bottom 33 of the bag body 30. FIG. 4 shows a bottom opening 66 of the bag body 30, as well as a closure 68 (e.g., a zipper, etc.) that may be associated with the bottom opening 66 in a manner that enables the bottom opening 66 to be selectively opened, as shown in FIG. 5, and closed, as shown in FIG. 4. As shown in FIG. 5, the bottom opening 66 provides selective access to a bottom portion of the secondary receptacle 60, which may, in some embodiments, also comprise a tertiary receptacle 69 of the bag body 30.

More specifically, the bottom opening 66 may provide access to an expandable base 70. The expandable base 70 may extend across the bottom opening 66 of the bag body 30 but have a length that exceeds a distance across the secondary opening 66 (i.e., from a front side **66*f* of the secondary opening 66 to the opposite rear side 66*r* of the secondary opening 66), as well a distance across the secondary receptacle 60. Thus, the expandable base 70 can be pulled from the secondary receptacle 60 of the bag body 30 and through the bottom opening 66 to extend from the bottom 33 of the bag body 30 and extend the secondary receptacle 60 beyond the bottom 33 of the bag body 30, as shown in FIGS. 6-10**.

The expandable base 70 may comprise a pocket 72. A shape and dimensions of the pocket 72 may enable it to receive an edge of an oversized item, such as a portable computer (e.g., a laptop computer, a tablet computer, etc.) or a sleeve 100 for a portable computer (e.g., the sleeve 100 shown in FIG. 1, etc.). In embodiments where the expandable base 70 comprises a pocket 72, the pocket 72 may be placed in an inverted arrangement within the secondary receptacle 60 of the bag body 30. While in the inverted arrangement, the pocket 72 may define a tertiary receptacle 69 accessible through the bottom opening 66. The pocket 72 may isolate the tertiary receptacle 69 from a remainder of the secondary receptacle 60. Alternatively, the expandable base 70 may comprise one or more straps.

With returned reference to FIG. 3, the sling bag 20 may include a retention system 80 associated with the secondary opening 62 in the top 32 of the bag body 30. The retention system 80 may engage a portion of an item (e.g., the sleeve 100 (FIG. 1), a portable computer, etc.) that protrudes from the secondary opening 62, beyond the top 32 of the bag body 30. When placed and secured in place over an edge of such an item, the retention system 80 may prevent inadvertent removal of the item from the secondary receptacle 60 of the bag body 30.

In the embodiment illustrated by FIGS. 3 and 6-10, the retention system 80 may include a retention strap 82 located adjacent to one side (e.g., side **62*r*, etc.) of the secondary opening 62 in the top 32 of the bag body 30. One end (not shown) of the retention strap 82 may be secured (e.g., sewn, etc.) to the bag body 30. The other end 84 of the retention strap 80 may carry a first element 86 of a coupler 85 (e.g., a first element of a buckle; a hook, as depicted; etc.). A length of the retention strap 82 may be adjustable. A retention loop 88 may be located adjacent to another side (e.g., side 62*f*, etc.) of the secondary opening 62. The retention loop 88 may be secured (e.g., sewn, etc.) to the bag body 30. In some embodiments (e.g., those where the coupler 85 comprises a buckle, etc.), the retention loop 88 may carry a second element (not shown) of the coupler 85 (e.g., a second element of a buckle, etc.). The first element 86 and the second element (not shown) of the coupler 85 may releasably engage one another. In some embodiments, the elements of the retention system 80 may be located within the secondary receptacle 60 of the bag body 30, just inside the secondary opening 62**.

Figure 11:
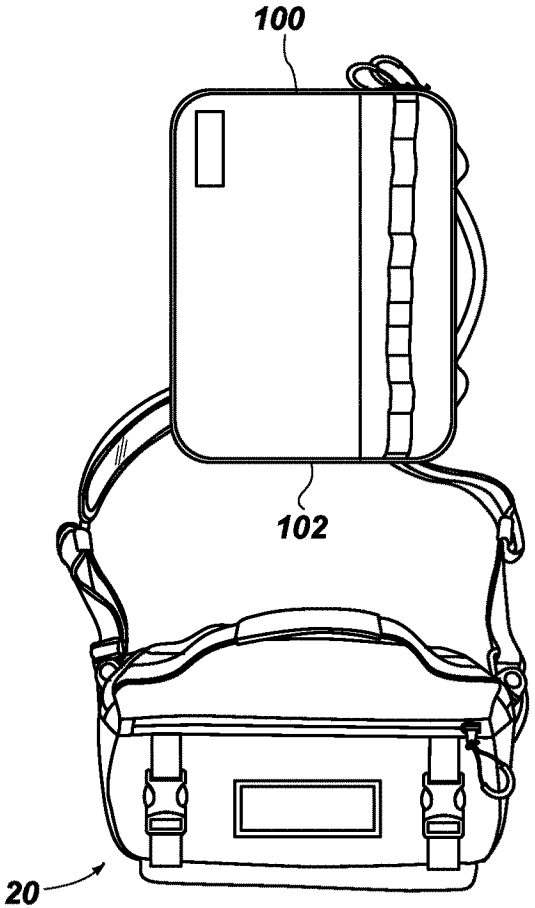
FIGS. 11-13 illustrate an embodiment of a method for introducing the embodiment of sleeve shown in FIG. 1 into a secondary receptacle of the embodiment of sling bag shown in FIG. 1.
Figure 12:
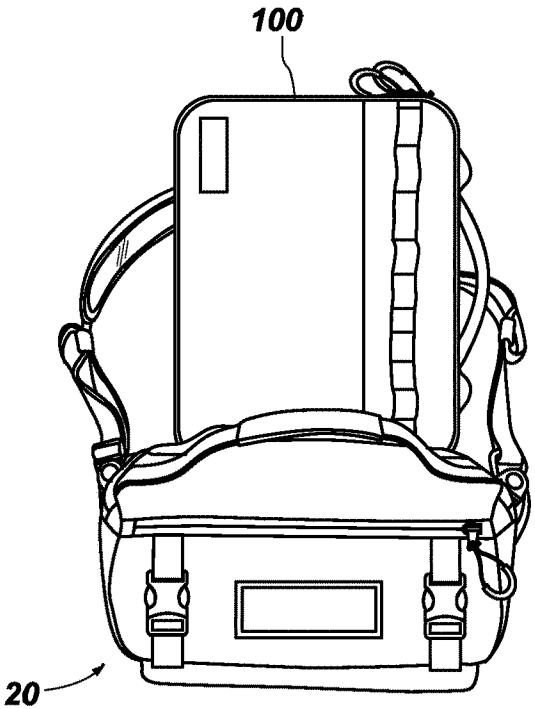
Figure 13:
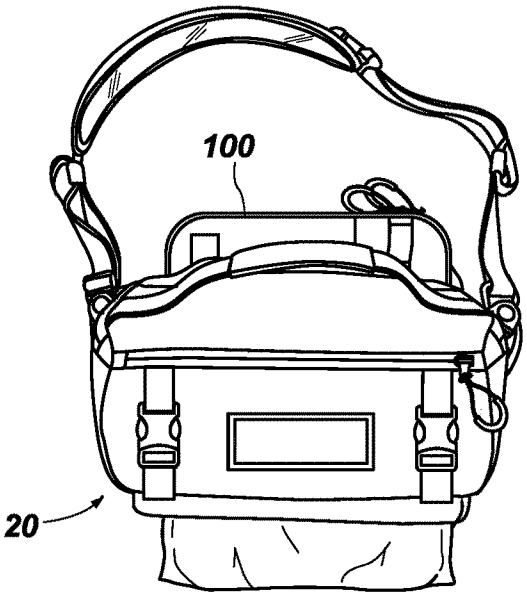

An oversized item, such as a portable computer or another item may be carried by the sling bag 20. Initially, with reference to FIG. 2, the closure 64 for the secondary opening 62 at the top 32 of the bag body 30 is opened to provide access to the secondary receptacle 60. The closure 68 for the bottom opening 66 at the bottom 33 of the bag body 30 is also opened, as shown in FIG. 3, to provide access to the expandable base 70 and to enable it to be extended through the bottom opening 66. With reference to FIG. 11, a sleeve 100, which may carry a portable computer (not shown) and/or one or more other items, is oriented over the sling bag 20. As illustrated in FIG. 12, an edge 102 (FIG. 11) of the sleeve 100 is inserted into the secondary opening 62 (FIG. 3) and the secondary receptacle 60 (FIG. 3). As the edge 102 of the sleeve 100 moves through the secondary receptacle 60 toward the bottom opening 66 (FIG. 5), it may contact the expandable base 70 and force the expandable base 70 through the bottom opening 66, as shown in FIG. 13. An upper surface (not shown) of the expandable base 70 carries the edge 102 and an adjacent portion of the sleeve 100 and limits the extent to which the sleeve 100 may extend beyond the bottom opening 66.

Figure 16:
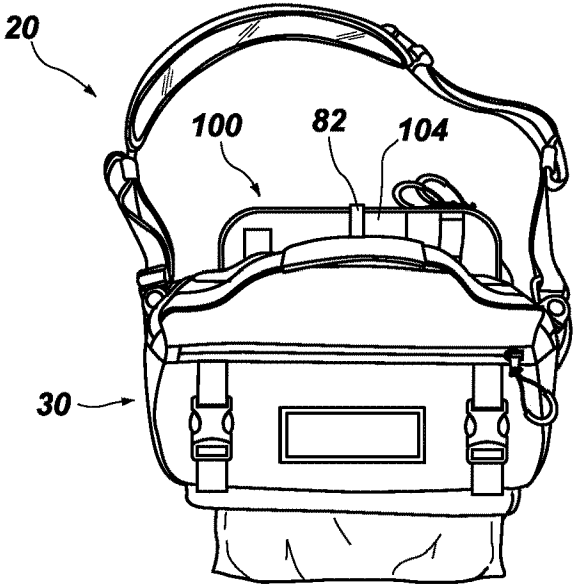
FIGS. 14-16 illustrate an embodiment of a method for securing the embodiment of sleeve shown in FIG. 1 in the secondary receptacle of the embodiment of sling bag shown in FIG. 1.
Figure 15:
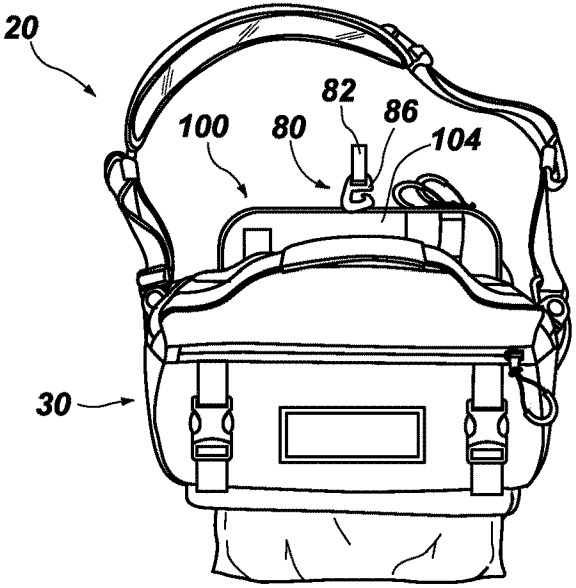
Figure 14:
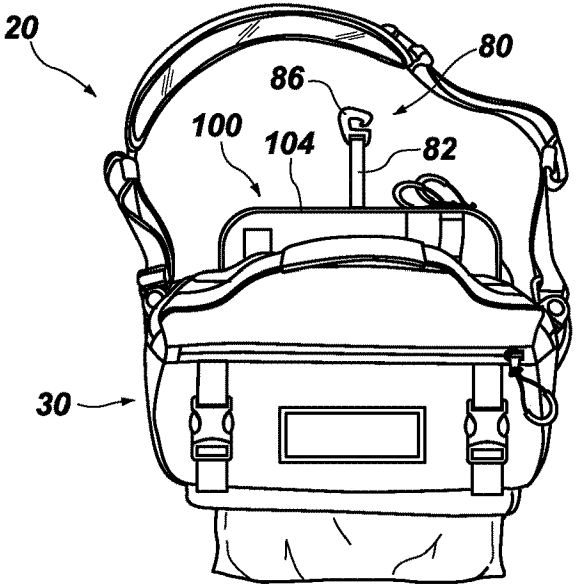

Once the sleeve 100 has been fully inserted into the extended secondary receptacle 60 (FIG. 3) of the bag body 30 of the sling bag 20, an edge 104 of the sleeve 100 may protrude beyond the top 32 of the bag body 30. The sleeve 100 may be secured in place by positioning and securing the retention system 80 over the edge 104 of the sleeve 100. More specifically, as shown in FIGS. 14-16, a retention strap 82 of the retention system 80 may be extended to a location beyond the edge 104 of the sleeve 100 (FIG. 14), positioned over, or across, the edge 104 of the sleeve 100 (FIG. 15), and secured in place over the edge 104 of the sleeve 100 (FIG. 16). Even more specifically, a first element 86 of a coupler 85 (e.g., a buckle, etc.) on an end 84 of the retention strap 82 may be releasably coupled to a retention loop 88 (FIGS. 6 and 8) or to a second element (not shown) of the coupler 85 carried by the retention loop 88.

As an alternative to inserting the sleeve 100 into the expanded secondary receptacle 60 and securing the sleeve 100 in place within the expanded secondary receptacle 60, any other suitably shaped item, such as a portable computer (e.g., a laptop computer, a tablet computer, etc.), may be placed within the expanded secondary receptacle 60 and secured in place therein.

Figure 10:
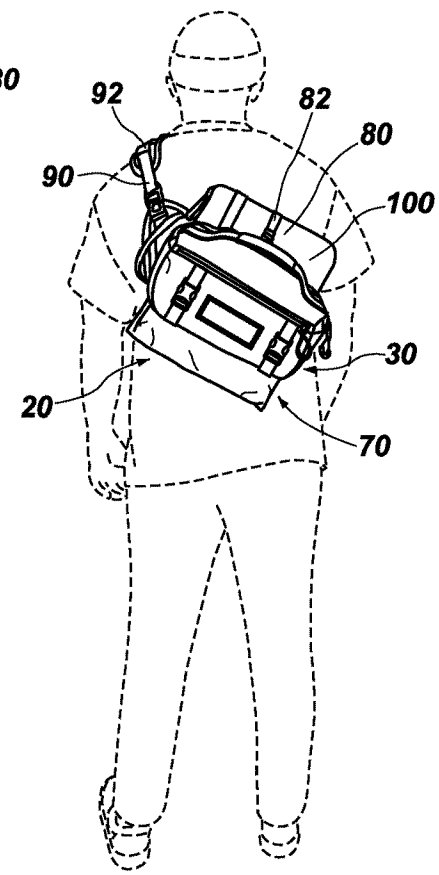
FIG. 10 shows an individual wearing the embodiment of sling bag shown in FIG. 1, in the arrangement shown in FIG. 6, and carrying the embodiment of portable computer sleeve shown in FIG. 1.
Figure 8:
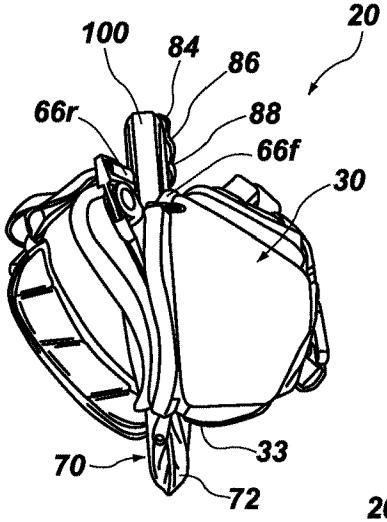
FIG. 8 is a side view of the embodiment of sling bag shown in FIG. 1, in the arrangement shown in FIG. 6 and carrying the embodiment of sleeve shown in FIG. 1.
Figure 9:
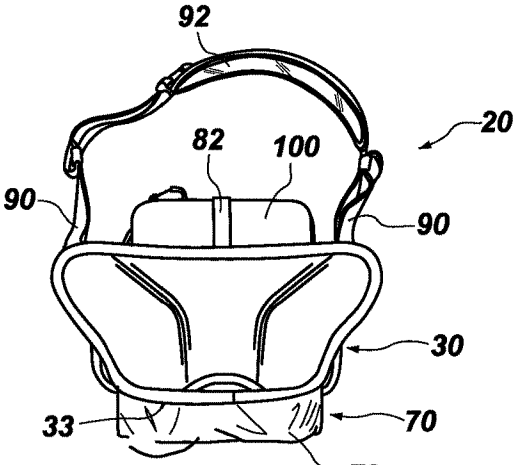
FIG. 9 is a rear view of the embodiment of sling bag shown in FIG. 1, in the arrangement shown in FIG. 6 and carrying the embodiment of sleeve shown in FIG. 1.
Figure 7:
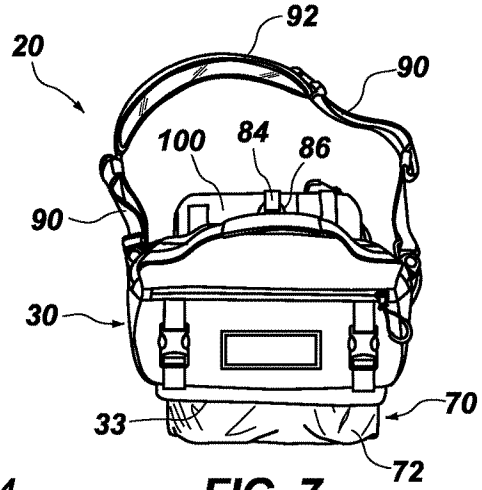
FIG. 7 is a front view of the embodiment of sling bag shown in FIG. 1, in the arrangement shown in FIG. 6 and carrying the embodiment of sleeve shown in FIG. 1.
Figure 6:
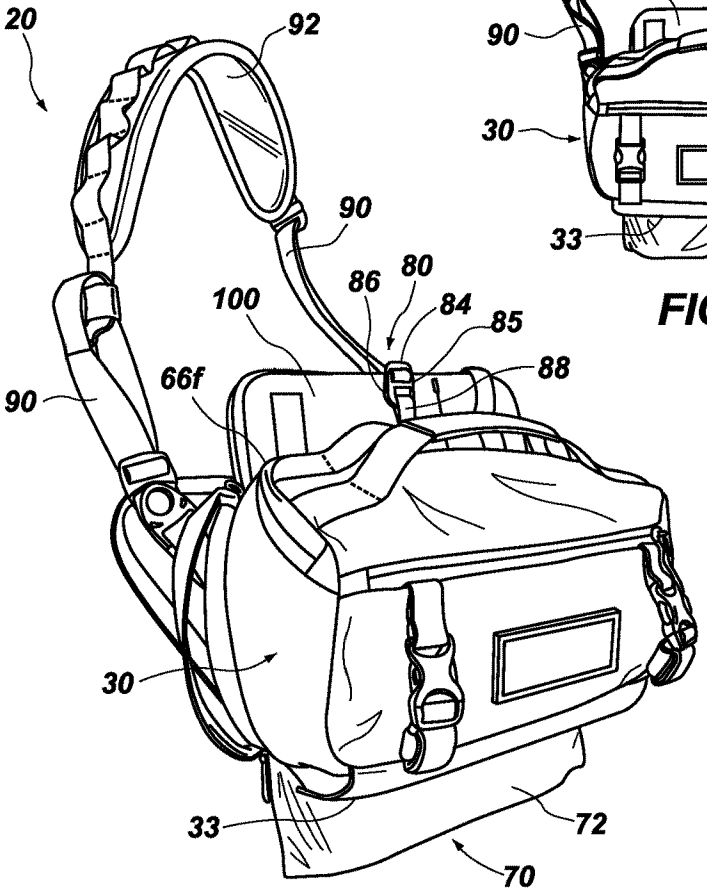
FIG. 6 is a perspective view of the embodiment of sling bag shown in FIG. 1, with the sling bag in an expanded arrangement and carrying the embodiment of sleeve shown in FIG. 1.

Returning reference now to FIGS. 6-10, the shoulder strap 90 of the sling bag 20 may have a configuration and be coupled to the bag body 30 in a manner that enables it to be worn over an individual's shoulder across the individual's chest or back, and other the individual's other arm, as seen in FIG. 10. More specifically, a shoulder pad 92 carried by the shoulder strap 90 may be positioned along a length of the shoulder strap 90 at a location that, when the shoulder pad 92 is positioned on the individual's shoulder, as illustrated by FIG. 10, the shoulder strap 90 will position the bag body 30 of the sling bag 20 at a desired location across the individual's body. Without limitation, the shoulder strap 90 may position the bag body 30 across the individual's back, as illustrated by FIG. 10, across his or her chest and/or abdomen, or at least partially across the individual's side, beneath his or her arm.

In embodiments such as that shown in FIG. 3 where the secondary receptacle 60 of the bag body 30 is located behind the primary receptacle 40 of the bag body 30 and the sling bag 20 is worn with the rear 35 of the bag body 30 against an individual's body, the individual's body may provide some protection for the contents of the expanded secondary receptacle 60, such as a the sleeve 100 and its contents, a portable computer, or the like.

With returned reference to FIG. 5, upon removing the sleeve 100 (FIG. 1) or other item from the sling bag 20, the expandable base 70 may be pushed back into the bottom opening 66. The closure 68 may be placed in a closed arrangement until access to the bottom portion of the secondary receptacle 60 or to the tertiary receptacle 69 is desired (e.g., for storage, etc.). The closure 64 on the secondary opening 62 may also be placed in a closed orientation until access to the secondary receptacle 60 is desired (e.g., for storage; for insertion of the sleeve 100, a portable computer, etc; etc.).

Referring now to FIGS. 17-20, a sleeve 100 that carries a portable computer 110 that may be used with the sling bag 20 shown in FIGS. 1-16 may include a base 102 and a top 104 pivotally associated with the base 102. The base 102 and the top 104 may be formed from a material that will protect the portable computer 110. Without limitation, the base 102 and the top 104 may include a material (e.g., neoprene, another foam rubber, silicone, etc., which may be enclosed in a fabric shell) that will cushion the portable computer 110 against impacts by other objects.

In addition to the base 102 and the top 104, the sleeve 100 may include a closure 108 (e.g., a zipper, etc.) that can secure the top 104 to the base 102 in a manner that encloses the portable computer 110 between the base 102 and the top 104.

The base 102 of the sleeve 100 may include at least one retainer 103 that engages a portion (e.g., a corner, an edge, etc.) of the portable computer 110 in a manner that enables use of the portable computer 110 while the portable computer 110 is secured to the base 102. The at least one retainer 103 may comprise any suitable structure, such as one or more pockets, one or more elastic straps, one or more magnets, etc., adjacent to a front edge 102*f* of the base 102.

Figures 17, 18, 19, 20:
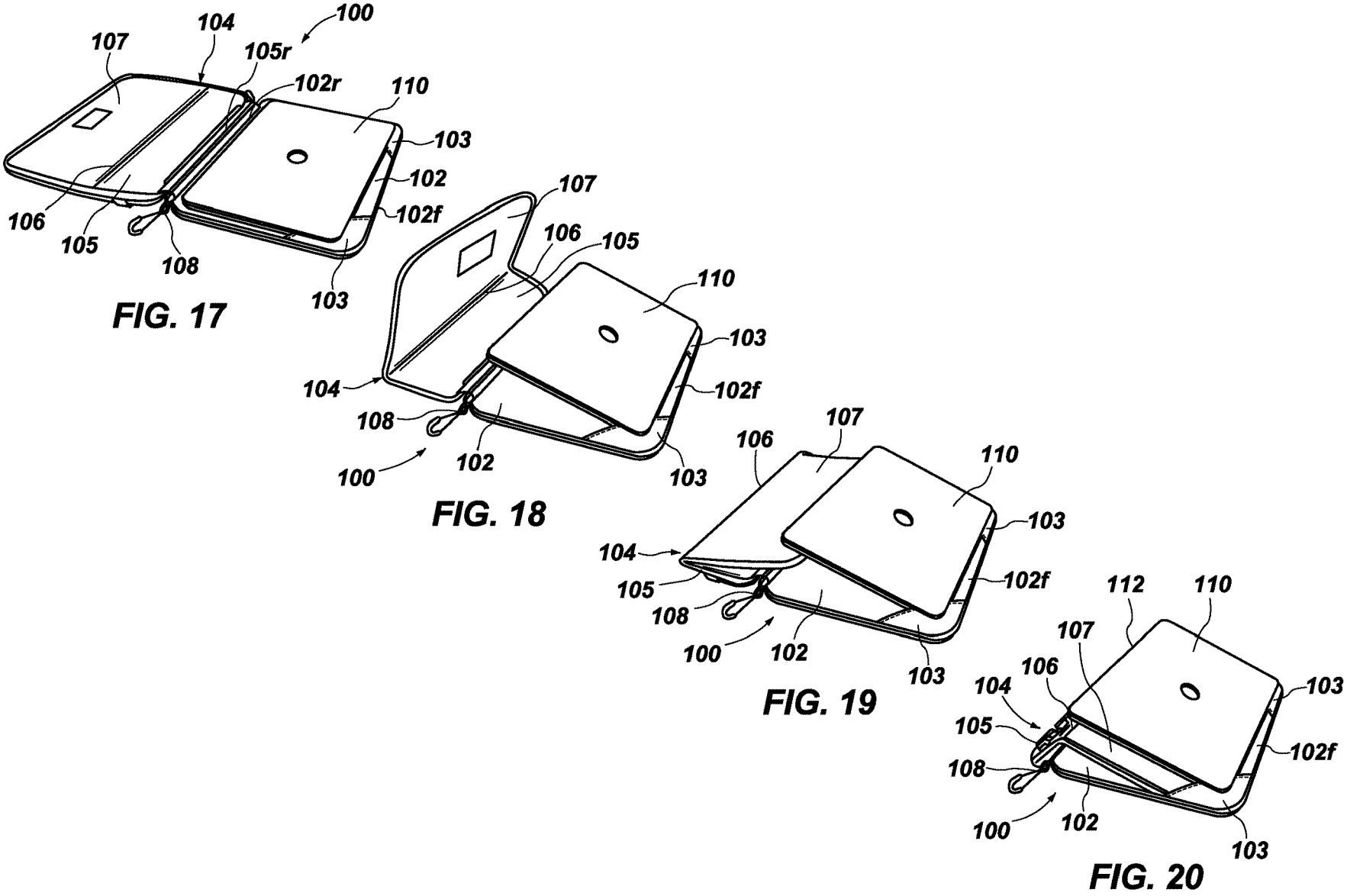
FIGS. 17-20 illustrate an embodiment of use of the embodiment of sleeve shown in FIG. 1 with a portable computer.

The top 104 of the sleeve 100 may pivot between a closed position over the base 102, as shown in FIG. 1, and an open position relative to the base, as shown in FIG. 17, which provides access to a portable computer 110 carried by the sleeve 100. The top 104 of the sleeve 100 may include a rear section 105, which includes a rear edge 105*r* pivotally connected to a rear edge 102*r* of the base 102, and a front section 107. A hinge 106 may join the rear section 105 and the front section 107 of the top 104 in a manner that enables the top 104 to bend. More specifically, as shown in FIGS. 18 and 19, while the rear section 105 of the top 104 of the sleeve 100 remains relatively flat against a surface, the front section 107 of the top 104 of the sleeve 100 may be folded over the rear section 105 and over a rear portion of the base 102 of the sleeve 100. In addition, as shown in FIG. 19, the front section 107 may be inserted beneath the portable computer 110 to orient the portable computer 110 at an inclined angle, or in a working orientation. As FIG. 20 shows, the front section 107 may be tucked in between a bottom of the portable computer 110 and the base 102, with the rear section 105 lifting a rear edge 112 of the portable computer 110 and the at least one retainer 103 of the base 102 holding the front section 107 in place between the bottom of the portable computer 110 and the base 102.

When use of the portable computer 110 is complete, the top 104 of the sleeve 100 may be removed from beneath the portable computer 110 and placed over the portable computer 110. The closure 108 may be closed to secure the top 104 over the portable computer 110 and to the base 102 of the sleeve 100, thereby securely storing the portable computer 110 within the sleeve 100.

Although the preceding description and the accompanying drawings are limited to a few specific embodiments, the specific embodiments that have been described and illustrated should not be construed as limiting the scope of any of the appended claims. Features from different embodiments may be employed in combination. All additions to, deletions from, and modifications of the disclosed subject matter that fall within the scopes of the claims are to be embraced by the claims.

What is claimed:

1. A sling bag for use with a portable computer comprising a laptop computer or a tablet computer and having a first major dimension comprising one of a length and a width of the portable computer and a second major dimension comprising another of the length and the width of the portable computer, with the second major dimension being the same as or larger than the first major dimension, the sling bag comprising:

a bag body having a back, a front, side edges, a top, a bottom, a width, and a height, with the width of the bag body exceeding the height of the bag body and being greater than the first major dimension of the portable computer and the height of the bag body being smaller than the second major dimension of the portable computer, the bag body including:

a primary receptacle accessible through a primary opening in the top of the bag body;

a secondary receptacle accessible from a secondary opening in the top of the bag body, the secondary opening having a length and the secondary receptacle having a width that enable the secondary opening and the secondary receptacle to receive the first major dimension of the portable computer inserted therethrough;

a bottom opening beneath the secondary opening, the bottom opening having a length that enables the bottom opening to receive the first major dimension of the portable computer inserted therethrough; and a bottom closure for the bottom opening;

an expandable base extending across a bottom portion of the secondary receptacle, collapsible within the bottom portion of the secondary receptacle, accessible from the bottom opening of the bag body, and extendable through the bottom opening of the bag body to expand the secondary receptacle through the bottom opening when the bottom closure is open, a combined length of the expandable base and the secondary receptacle being sufficient to receive the second major dimension of the portable computer;

a shoulder strap securable to the bag body; and a retention system comprising a strap extendable over only a portion of the secondary opening in the top of the bag body, between a rear location adjacent to the back of the bag body and front location toward the front of the bag body, the strap securable in place over the secondary opening.

2. The sling bag of claim 1, wherein the expandable base of the sling bag extends across an entirety of the bottom portion of the secondary receptacle of the bag body of the sling bag.

3. The sling bag of claim 1, wherein the strap is positionable over a first edge of the portable computer when the portable computer is inserted into the secondary receptacle of the bag body of the sling bag, with the first edge of the portable computer protruding from the secondary opening of the bag body, a central portion of the portable computer located between the secondary opening and the bottom opening of the bag body, and a second edge of the portable computer located beyond the bottom opening of the bag body and retained by the expandable base of the sling bag.

4. The sling bag of claim 1, wherein the strap is secured in place relative to a back of the secondary receptacle of the bag body of the sling bag, adjacent to a top portion of the secondary receptacle.

5. The sling bag of claim 1, wherein the shoulder strap is secured to the bag body of the sling bag to enable the sling bag to be worn over an individual's chest, abdomen, side, or back.

6. The sling bag of claim 1, wherein:

the primary opening and the primary receptacle of the bag body of the sling bag are located adjacent to a front of the bag body; and the secondary opening, the secondary receptacle, and the bottom opening of the bag body of the sling bag are located adjacent to a rear of the bag body.

7. The sling bag of claim 6, further comprising:

a protective pad at the rear of the bag body, adjacent to the secondary receptacle.

8. The sling bag of claim 1, wherein, with the bottom closure of the bag body of the sling bag open and the expandable base of the sling bag extended through the bottom opening, the secondary receptacle of the bag body can receive the portable computer, with a first edge of the portable computer located above the secondary opening, a central portion of the portable computer located between the secondary opening and the bottom opening, and a second edge of the portable computer located beyond the bottom opening and retained by the expandable base.

9. The sling bag of claim 8, wherein the expandable base of the sling bag comprises a pocket with a shape and dimensions that enable the expandable base to receive an edge of the portable computer.

10. The sling bag of claim 9, wherein the pocket provides a tertiary receptacle when the bottom closure of the bag body is open and the expandable base is in an inverted arrangement within the secondary receptacle of the bag body.

11. The sling bag of claim 10, wherein the pocket isolates the tertiary receptacle from the secondary receptacle.

12. A method for stowing a portable computer in a sling bag, comprising:

opening a bottom opening in a bottom of the sling bag;

extending an expandable base through the bottom opening;

introducing the portable computer into a secondary opening in a top of the sling bag, at least partially through a secondary receptacle, through the bottom opening, and into the expandable base, with a first edge of the portable computer extending beyond the top of the sling bag, the first edge of the portable computer or a first edge of a sleeve covering the portable computer exposed beyond the top of the sling bag, and a second edge of the portable computer therein extending beyond the bottom of the sling bag; and securing a retention system in place over the first edge of the portable computer protruding beyond the top of the sling bag, including extending over only a portion of the secondary opening, from a back of the secondary opening to a front of the secondary opening, and securing a strap in place over the first edge of the portable computer and the secondary opening.

13. The method of claim 12, wherein securing the retention system in place over the first edge of the portable computer comprises preventing the portable computer from being inadvertently removed from the sling bag.

14. The method of claim 12, further comprising:

removing the retention system from the first edge of the portable computer;

removing the portable computer from the expandable base, the secondary receptacle, and the secondary opening; and pushing the expandable base through the secondary opening and into the secondary receptacle.

15. The method of claim 14, further comprising:

closing the bottom opening.

16. The method of claim 15, further comprising:

re-opening the bottom opening to selectively access a bottom portion of the secondary receptacle of the sling bag.

17. In combination, a portable computer comprising a laptop computer or a tablet computer and having a first major dimension comprising one of a length and a width of the portable computer and a second major dimension comprising another of the length and the width of the portable computer, with the second major dimension being the same as or larger than the first major dimension;

a sleeve for carrying the portable computer and having a first major dimension that receives the first major dimension of the portable computer and a second major dimension that receives the second major dimension of the portable computer;

a bag body having a back, a front, side edges, a top, a bottom, a width, and a height, with the width of the bag body exceeding the height of the bag body and the width of the bag body being larger than the first major dimension of the sleeve and the height of the bag body being smaller than the second major dimension of the sleeve, the bag body including:

a primary receptacle accessible through a primary opening in the top of the bag body;

a secondary receptacle accessible from a secondary opening in the top of the bag body, the secondary opening having a length and the secondary receptacle having a width that enable the secondary opening and the secondary receptacle to receive the first major dimension of the sleeve;

a bottom opening beneath the secondary opening, the bottom opening having a length that enables the bottom opening to receive the first major dimension of the sleeve; and a bottom closure for the bottom opening; and an expandable base extending across a bottom portion of the secondary receptacle, collapsible within a bottom portion of the secondary receptacle, accessible from the bottom opening of the bag body, and extendable through the bottom opening of the bag body to expand the secondary receptacle through the bottom opening when the bottom closure is open; and a retention system comprising a strap extendable over only a portion of the secondary opening in the top of the bag body, between a rear location adjacent to the back of the bag body and front location toward the front of the bag body, the strap securable in place over the secondary opening.

18. The sling bag system of claim 17, further comprising:

a shoulder strap securable to the bag body.

* * * * *